US006076957A

United States Patent [19]

Gomes

[11] Patent Number: 6,076,957

[45] Date of Patent: Jun. 20, 2000

[54] MAGNETIC STIRRER ADAPTED FOR USE WITH MICROWAVE OVENS

[75] Inventor: Francis Gomes, Jersey City, N.J.

[73] Assignee: Bel-Art Products, Inc., Pequannock, N.J.

[21] Appl. No.: 09/255,305

[22] Filed: Feb. 22, 1999

[51] Int. Cl.[7] ..... B01F 13/08; H05B 6/78

[52] U.S. Cl. ..... 366/274; 219/726

[58] Field of Search ..... 366/208, 273, 366/274; 416/3; 99/348, DIG. 14; 219/726, 751, 754, 755

[56] References Cited

U.S. PATENT DOCUMENTS

| | | | |
|---|---|---|---|
| 3,601,372 | 8/1971 | Harmes, III . | |
| 4,286,133 | 8/1981 | Einset et al. . | |
| 4,568,195 | 2/1986 | Herz et al. . | |
| 4,742,202 | 5/1988 | Campbell et al. . | |
| 4,747,693 | 5/1988 | Kahl | 366/208 |
| 4,904,834 | 2/1990 | Bowen . | |
| 4,911,555 | 3/1990 | Saffer et al. . | |
| 4,959,517 | 9/1990 | Jump et al. . | |
| 5,166,486 | 11/1992 | Komatsu et al. . | |
| 5,302,792 | 4/1994 | No et al. . | |
| 5,345,068 | 9/1994 | Hatano et al. . | |
| 5,409,312 | 4/1995 | Fletcher . | |
| 5,511,879 | 4/1996 | Fletcher . | |
| 5,549,382 | 8/1996 | Correia, II et al. | 99/348 |
| 5,593,609 | 1/1997 | Fletcher . | |
| 5,899,567 | 5/1999 | Morris, Jr. | 366/274 |

OTHER PUBLICATIONS

Bel–Art Products Catalog Copyright 1998 pp. 200, 201, 419, 420, 421.

*Primary Examiner*—Charles E. Cooley
*Attorney, Agent, or Firm*—Lawrence G. Fridman

[57] ABSTRACT

A stirring device is adaptable for use in microwave ovens with turntables. The stirring device includes a gear train assembly that increases the normal rate of revolution of a microwave turntable by several fold. A driving head coupler is connected to a driving end of the gear train assembly and engages a turntable driving head, so that rotation of the driving head during use of the microwave oven causes rotation of the driving head coupler. A magnetic stirring actuator is connected to a driven end of the gear train assembly for rotation therewith. A magnetic stirring device is positioned in a container along with the contents to be heated and stirred. During use of the microwave oven, the turntable driving head rotates at a first rate of revolution and thereby causes a corresponding rotation of the actuator at a second rate of revolution greater than the first rate to thereby simultaneously heat and stir the contents situated in the container at the second rate of revolution. The driving head coupler is adaptable for use with microwave ovens having different sizes of driving heads.

18 Claims, 6 Drawing Sheets

MAGNETIC STIRRER ADAPTED FOR USE WITH MICROWAVE OVENS

BACKGROUND OF THE INVENTION

1. Field of the Invention

This invention relates to stirring devices, and more particularly to a magnetic stirring device that is energized by a driving head of a microwave turntable.

2. Description of the Related Art

A chemical or biological sample in a container may be stirred by placing a stirring magnet or stirring magnetic device in a container with a sample and subsequently applying an external rotating magnetic field to create a corresponding rotation of the stirring magnetic device. The stirring magnet is typically a small bar magnetic material which can be encased in an inert plastic with a magnetic pole axis oriented in a horizontal direction. In some stirring magnets, an extension may be formed around a middle portion of the magnetic bar to thereby raise the stirring magnet above the bottom of the container and facilitate rotation of the magnet in the container. This is because the plastic extension exhibits a smaller surface area than the flat magnet.

In conventional magnetic stirrers, typically a motor mechanically rotates a drive bar magnet about a vertical axis of rotation. The drive bar magnet in turn rotates the stirring magnet in the container to thereby stir a chemical or biological sample. Where integrity of the sample must be maintained, a sterile stirring magnet may be sealed with the sample in the container so as to isolate the sample and stirring magnet from contaminating environments or particles. When the sample in the container requires heating, the continuous stirring of the magnetic stirrer helps to uniformly distribute the heat throughout the sample.

Nevertheless, heating of chemical or biological samples in microwave ovens has often been unpopular due to uneven spatial distribution of microwave energy in the oven cavity. As a result, "hot spots" and "cold spots" may be produced at different locations within the oven cavity, which may lead to unsatisfactory heating of the samples. Even microwave ovens with turntables can be ineffective in evenly distributing the heat within the sample. The turntables in many microwave ovens typically rotate at about five to six revolutions per minute, which is too slow for uniform distribution of heat in many chemical and biological samples. Ideally, the sample should be constantly stirred at a higher rotational speed during the heating process. This is necessary to uniformly distribute the heat throughout the sample while assuring that the sample is thoroughly mixed.

U.S. Pat. No. 5,593,609 to Fletcher discloses a mixing device for a microwave oven that has a gear assembly driven by a motor for moving a support plate in an orbital action during operation of the microwave oven. In one embodiment of this patent, the motor is a part of the microwave oven. In another embodiment of this patent, the mixing device can be self-contained with its own shielded motor and the assembly can be placed on the turntable of the microwave oven. During the heating mode, a container with a sample to be heated is placed on top of the support plate and both are moved in an orbital action during heating. In this patent, there is no provision for directly stirring the contents of the container by magnetic stirring bars for example. Moreover, this mixing device is not readily adaptable to be energized by turntable drive heads associated with microwave ovens.

SUMMARY OF THE INVENTION

It is an object of the invention to provide a stirring device that can be mounted in a microwave oven.

It is a further object of the invention to provide a stirring device that is adaptable for use with turntable drive heads of different configurations associated with microwave ovens.

It is an even further object of the invention to provide a stirring device for microwave ovens for directly stirring contents in a container during operation of the microwave oven.

One aspect of the invention provides a stirring device adaptable for use in a microwave oven having an interior compartment and a turntable driving head in communication with the compartment. The stirring device comprises a housing adapted for positioning in the interior compartment and a surface of the housing for supporting a container thereon. A gear train assembly is located in the housing. The gear train assembly includes at least a driving gear connected for rotation with a driven gear, a ratio of rotation of the driven gear with respect to the driving gear being greater than unity. A driving head coupler is connected to the driving gear for rotation therewith. The driving head coupler has at least one contact element for engaging the turntable driving head such that rotation of the driving head during use of the microwave oven causes rotation of the driving head coupler. An actuator is connected to the driven gear for rotation therewith. With this arrangement, the turntable driving head rotates during operation of the microwave oven at a first rate of revolution and thereby causes a corresponding rotation of the actuator at a second rate of revolution greater than the first rate to thereby simultaneously heat and stir contents that may be located in the container at the second rate of revolution.

A stirring element responsive to the actuator can be placed directly in the container with the contents. When the actuator rotates at the second rate of revolution, the stirring element also rotates in the container at the same rate of revolution. Preferably, the actuator comprises at least one magnet, and the stirring element is magnetically responsive to the at least one magnet.

According to a further aspect of the invention, the driving head coupler comprises adjustment means for engaging turntable driving heads of different heights and configurations.

According to another aspect of the invention mounting means is provided which is connected to the base member of the housing for removable mounting the stirring device in the interior compartment of the microwave oven. The mounting means comprises support elements arranged around a periphery of the base member. The support elements can be slidable toward and away from a center portion of the base member for adjusting to the interior compartment of different sizes.

There are, of course, additional features of the invention that will be described hereinafter which will form the subject matter of the appended claims. Those skilled in the art will appreciate that the preferred embodiments may readily be used as a basis for designing other structures, methods and systems for carrying out the several purposes of the present invention.

It is important, therefore, that the claims be regarded as including such equivalent constructions since they do not depart from the spirit and scope of the present invention. The foregoing and other features and advantages of the invention will be apparent from the following more particular description of preferred embodiments of the invention, as illustrated in the accompanying drawings.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

DETAILED DESCRIPTION OF THE PREFERRED EMBODIMENT

Figure 1:
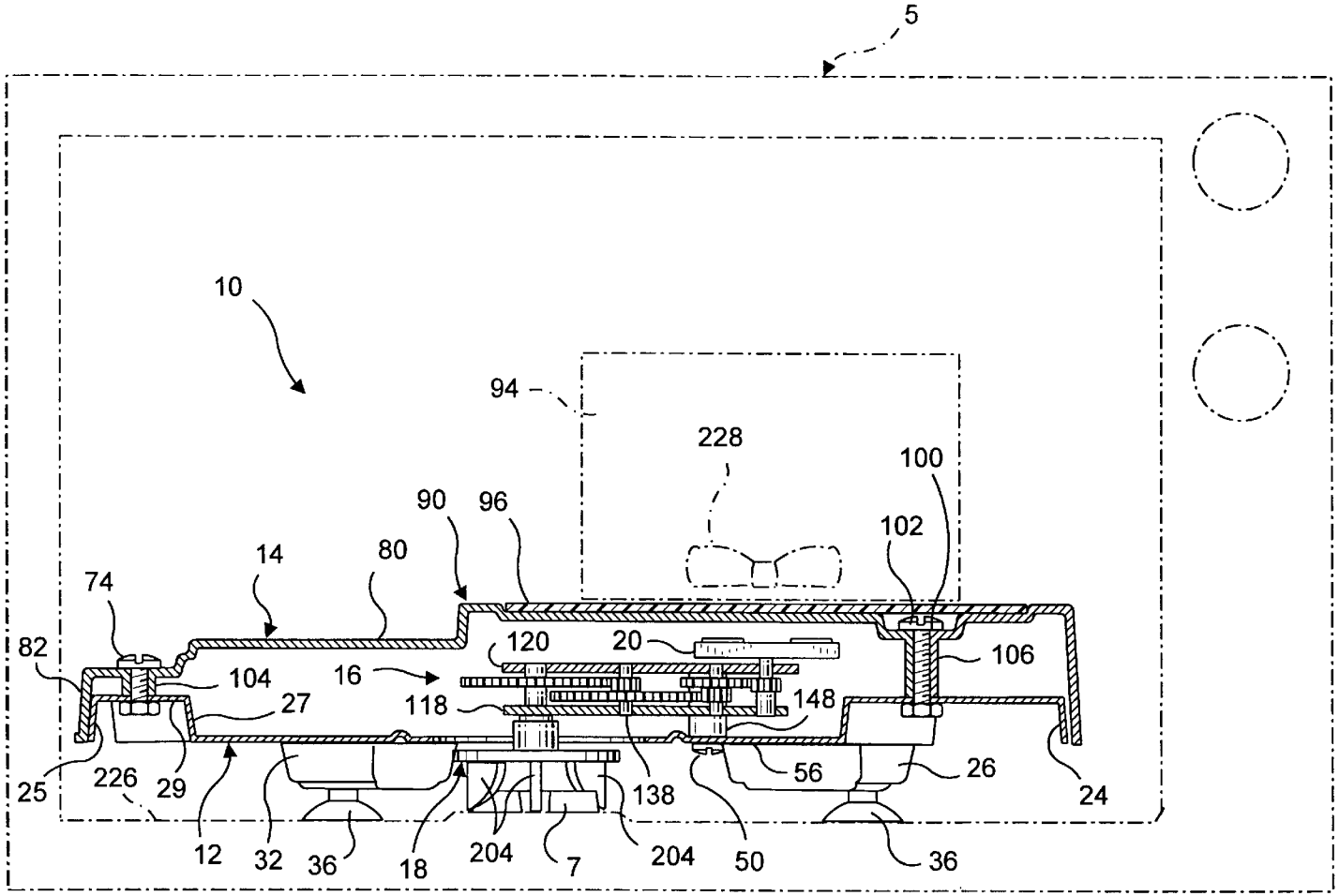
FIG. 1 is a front elevational view in partial cross-section of a magnetic stirring device according to the invention adopted for use with a microwave oven.

Referring now to the drawings in general and to FIG. 1 in particular, wherein a magnetic stirring device 10 for use in a conventional microwave oven 5 (shown in dashed line) with a turntable driving head 7 is illustrated. The magnetic stirring device 10 comprises a base member 12, an upper support member 14, a gear train assembly 16 mounted between the base member 12 and support member 14, a driving head coupler 18 connected to a driving end of the gear train assembly, and a stirring actuator 20 connected to a driven end of the gear train assembly.

Figure 2A:
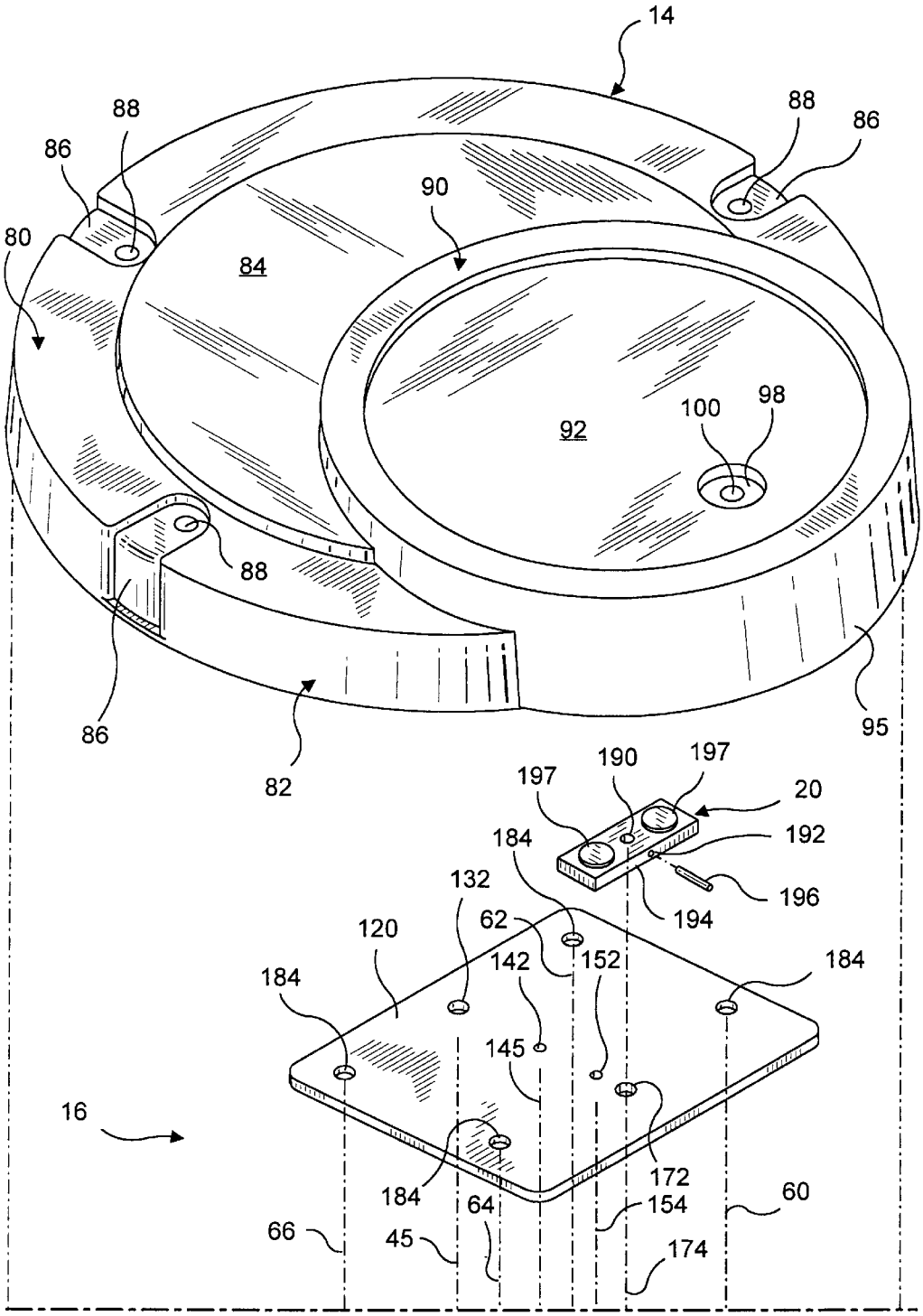
FIGS. 2A to 2D show an exploded isometric view of the magnetic stirring device of FIG. 1.
Figure 2B:
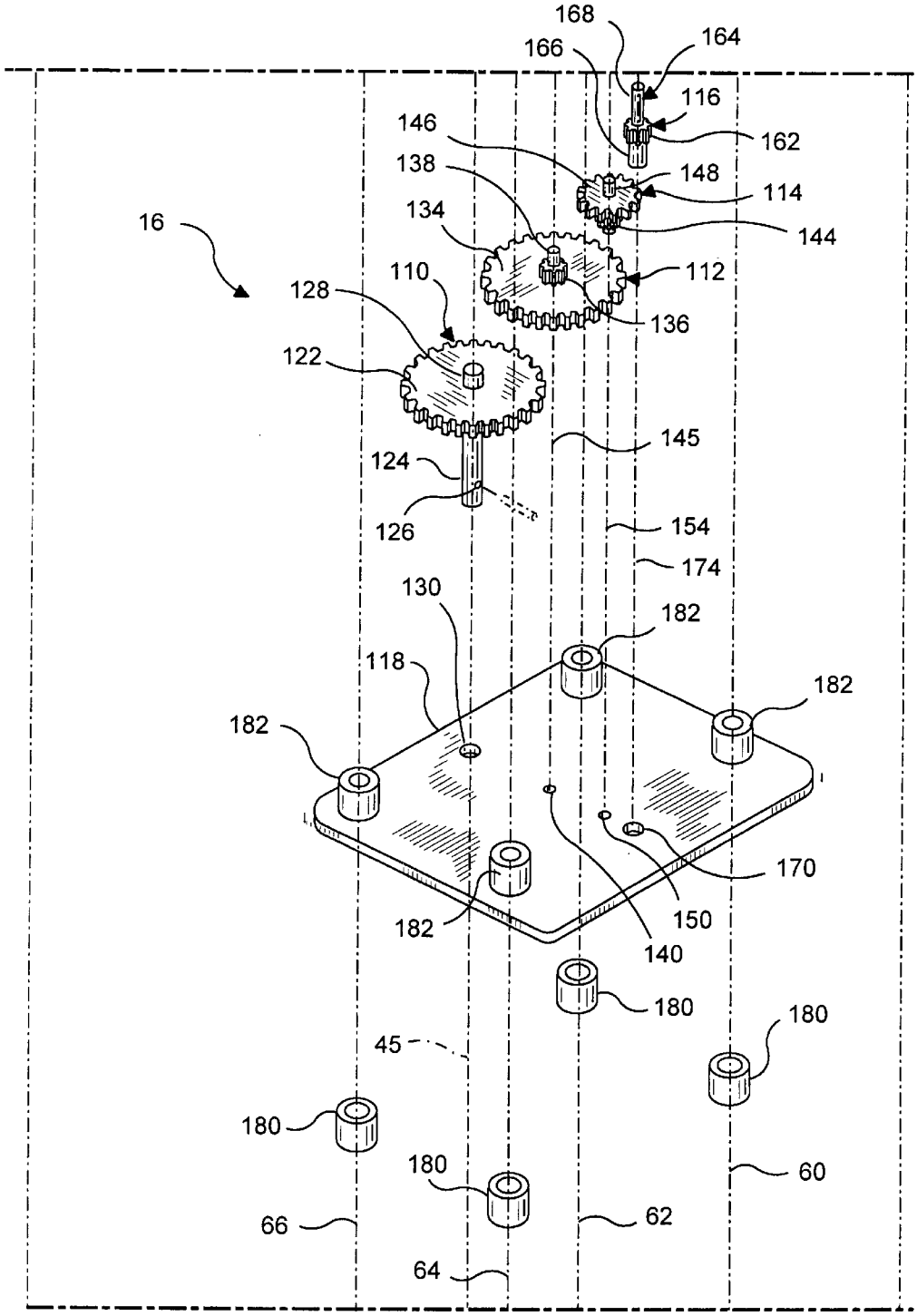
Figure 2C:
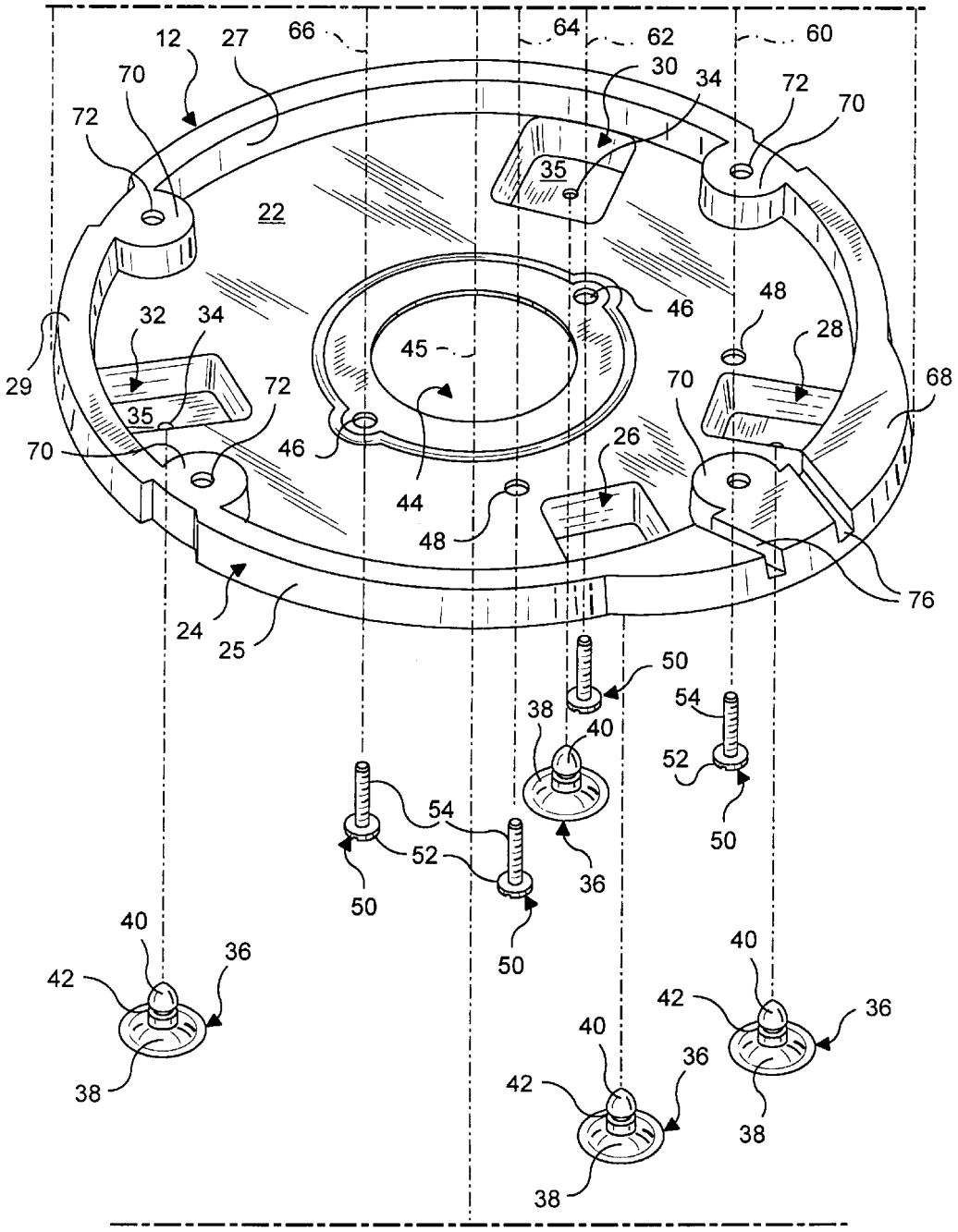
Figure 4:
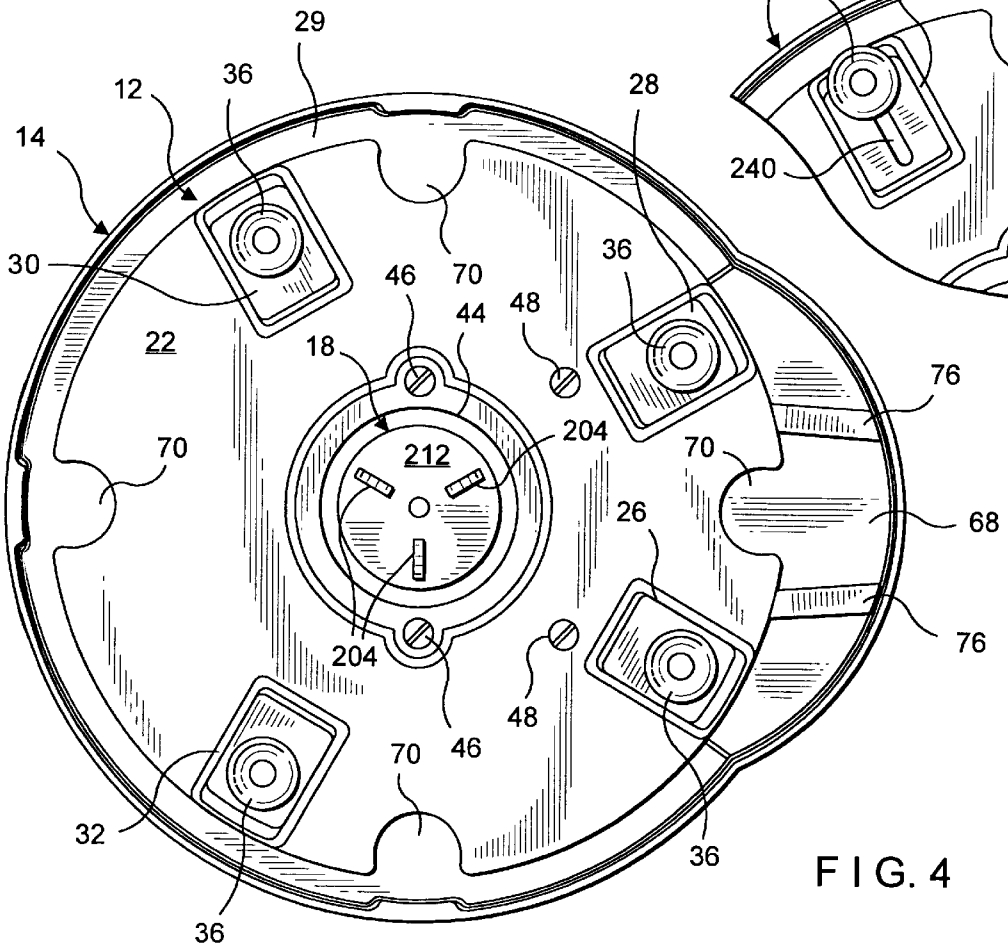
FIG. 4 is a bottom plan view of the magnetic stirring device.

Referring now to FIGS. 2C and 4, the base member 12 is generally circular in shape and includes a floor 22 with a peripheral wall 24 projecting upwardly from the floor. The wall 24 includes an outer generally vertical wall section 25 connected to an inner generally vertical wall section 27 by a central bight portion or web 29. Depressions 26, 28, 30, and 32 are formed in the floor with an aperture 34 extending through a bottom wall 35 of each depression.

A suction cup 36 having a suction base 38 and a bullet-shaped mounting top 40 extending upwardly from the base is inserted into each aperture 34 such that the bottom wall 35 of each depression is received in a slot 42 of the mounting top 40. The suctions cups 36 are adapted to engage a supporting surface 226 (See FIG. 1) of the microwave oven under vacuum to thereby hold the base member against movement. Although suctions cups are preferred, other means for supporting the base member 12 on the surface 226 can be used, such as non-skid feet, adhesives, fasteners, and the like.

As best illustrated in FIG. 4, the depressions 26 and 28 are positioned closer to each other than the depressions 30 and 32 for supporting the weight of a container 94 (shown in broken line in FIG. 1) and any contents that may be in the container, as will be described in greater detail herein below.

An opening 44 extends through a central portion of the floor 22. A center of the opening 44 is preferably in alignment with a first rotational axis 45 of the driving head coupler 18 when the device 10 is assembled. Apertures 46 are located adjacent the opening 44, whereas apertures 48 are spaced from the opening. Each aperture 46, 48 receives a fastener 50 for mounting the gear train assembly 16 to the base member 12.

Each fastener 50 includes a head 52 that abuts the lower surface 56 (See FIG. 1) of the base member and a threaded stud 54 that extends through one of the apertures 46, 48 aligned with one of the assembly lines 60, 62, 64, and 66. Although threaded fasteners are shown, it is to be understood that other fasteners or fastening techniques can be used to mount the gear train assembly 16 to the base member 12.

A lip 68 is formed in the base member 12 integrally with the wall 24 and extends radially outwardly from the first rotational axis 45. Projections 70 are formed integrally with the wall 24 and extend upwardly from the floor 22. Apertures 72 may extend through each projection and are sized to receive a fastener 74 (FIG. 1) for securing the base member 12 and upper support member 14 together. A pair of grooves 76 are formed in the lip 68 on either side of the projection 70 for reinforcing the lip.

With particular reference to FIG. 2A, the upper support member 14 is generally semi-circular shaped and includes an upper wall 80 with a peripheral wall 82 projecting downwardly from the upper wall 80. A step portion 84 is formed in the upper wall 80 to increase the strength and rigidity of the upper wall. Depressions 86 are formed in the upper wall 80 and peripheral wall 82. Apertures 88 may extend through each depression and are sized to receive a fastener 74 (FIG. 1) for securing the base member 12 and upper support member 14 together.

As best illustrated in FIGS. 1 and 2A, a raised platform 90 is integrally formed with the upper wall 80 and peripheral wall 82. The platform 90 includes a support surface 92 that is generally circular in shape and is adapted to receive a container 94 (shown in broken line in FIG. 1). A mat 96 may be positioned on the surface 92 for preventing slippage of the container 94 during use of the stirring device 10 as well as providing thermoinsulation between the heated container and the stirring device. An outer periphery 95 of the platform 90 is in alignment with the lip 68 on the base member 12. A recess 98 is formed in the support surface 92. An aperture 100 extends through the recess 98 and is sized to receive a fastener 102 (See FIG. 1) for further securing the base member 12 and upper support member 14 together.

As shown in FIG. 1, spacers 104 and 106 are positioned in alignment with the fasteners 74 and fastener 102, respectively, between the base member 12 and upper support member 14. Although fasteners 74 and 102 are shown, other fastening techniques may be used for connecting the base member 12 to the upper support member, such as adhesives, ultrasonic welding, and the like.

With reference now to FIGS. 2A and 2B, the gear train assembly 16 includes a driving gear 110, a first gear set 112, a second gear set 114, and a driven gear 116 mounted between a lower plate 118 and an upper plate 120.

The driving gear 110 includes a gear wheel 122 having a relatively large diameter. The gear wheel 122 is mounted on a shaft 124 such that a lower portion 126 of the shaft extending below the gear wheel is longer than an upper portion 128 of the shaft that extends above the gear wheel. The lower portion 126 of the shaft 124 extends through an aperture 130 in the lower plate 118 for rotation relative thereto and engages with the driving head coupler 18 (See FIG. 2D) for rotation therewith. The upper portion 128 of the shaft is rotatably received in an aperture 132 in the upper plate 120, such that a central axis of the driving gear shaft 124 is coincident with the first rotational axis 45.

The first gear set 112 includes a lower gear wheel 134 with a relatively large diameter and an upper gear wheel 136 with a relatively small diameter. The lower and upper gear wheels 134, 136 are mounted on a shaft 138 such that approximately equal portions of the shaft extend above and below the upper and lower gear wheels, respectively. A lower portion of the shaft 138 (See FIGS. 1, 2A and 2B) is rotatably received in an aperture 140 of the lower plate 118, while an upper portion of the shaft 138 is rotatably received in an aperture 142 of the upper plate 120. The first gear set 112 rotates about a second rotational axis 145. The upper gear wheel 136 has teeth that mesh with the teeth of the driving gear wheel 122.

The second gear set 114 includes a lower gear wheel 144 with a relatively small diameter and an upper gear wheel 146 with a diameter that is preferably smaller than the diameter of the gear wheel 134 and larger than the diameter of the gear wheel 144. The lower and upper gear wheels 144, 146 are mounted on a shaft 148, such that approximately equal portions of the shaft extend above and below the upper and lower gear wheels, respectively. A lower portion of the shaft 148 is rotatably received in an aperture 150 of the lower plate 118 while an upper portion of the shaft 148 is rotatably received in an aperture 152 of the upper plate 120. The second gear set 114 rotates about a third rotational axis 154. The lower gear wheel 144 of the second gear set 114 has teeth that mesh with the teeth of the lower gear wheel 134 of the first gear set 112.

The driven gear 116 includes a gear wheel 162 with a relatively small diameter mounted on a shaft 164 such that a lower portion 166 of the shaft extends below the gear wheel 162 and an upper portion 168 of the shaft extends above the gear wheel. Preferably, the lower portion 166 of the shaft 164 is larger in diameter than the upper portion 168 and is rotatably received in an aperture 170 in the lower plate 118. The upper portion 168 of the shaft 164 extends through an aperture 172 in the upper plate 120 and projects above the plate for mounting the actuator 20 thereto. A central axis of the driven gear shaft 164 is coincident with a fourth rotational axis 174. The gear wheel 162 of driven gear 116 has teeth that mesh with the teeth of the upper gear wheel 146 of the second gear set 114.

The studs 54 of fasteners 50 (See FIG. 2C) extend through lower spacers 180, apertures (not shown) in the lower plate 118, upper spacers 182, and apertures 184 in the upper plate 120. The apertures 184 may be threaded to receive the threads of the studs 54, or a separate nut (not shown) may be provided and the fasteners threaded into the nuts for securing the gear train assembly together and for mounting the gear train assembly on the base member 12.

When assembled, the gear train assembly 16 is mounted between the upper and lower plates, with the upper spacers 182 sandwiched between the upper and lower plates, and the lower spacers 180 sandwiched between the base member 12 and the lower plate 118.

As shown in FIG. 2A, the actuator 20 is preferably formed having an elongated configuration and including a central aperture 190 that is sized to receive the upper shaft portion 168 of the driven gear 116 (See FIG. 2B) for rotation therewith. A threaded aperture 192 extends from a side 194 of the bar 20 and intersects with the aperture 190. A threaded stud or any other fastener 196 is received within the aperture and secures the actuator 20 to the upper shaft portion 168. Preferably, the actuator 20 includes a pair of magnets 197 that are mounted on opposite sides of the aperture 190. The magnets drive a stirring bar 228 (See FIG. 1) that may be located in the container 94 for directly stirring the contents of the container when the actuator is rotated. In an alternate embodiment, the actuator may be a turntable or similar mechanism for directly supporting a container thereon to thereby rotate the container at an increased rate of revolution.

Figure 2D:
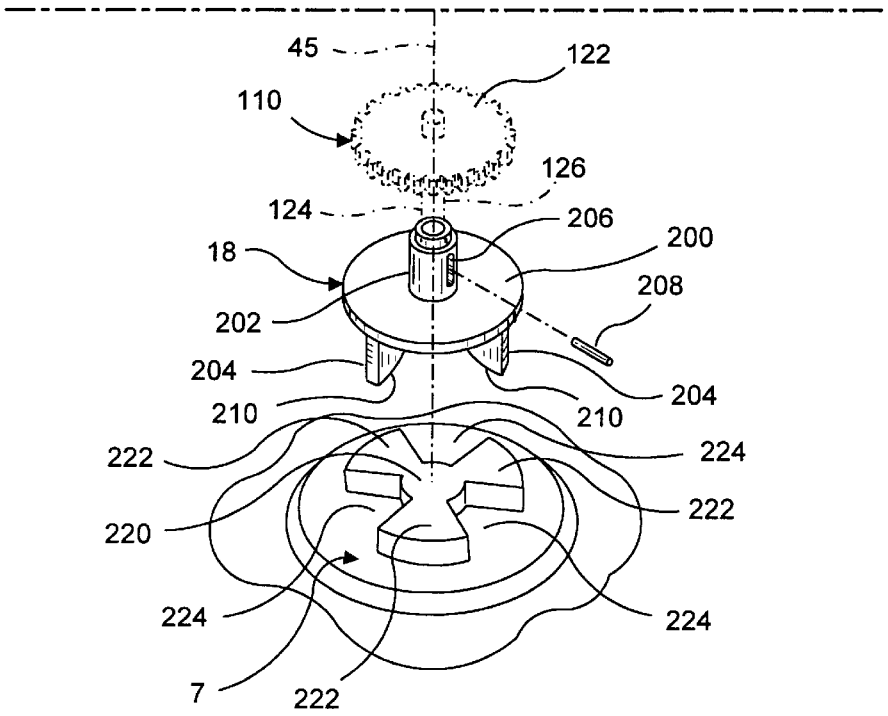

Referring now to FIG. 2D, the driving head coupler 18 includes a disk 200, a collar 202 that projects upwardly from the disk along the first rotational axis 45, and engagement members 204 that project downwardly from the disk. An elongate slot 206 is formed in the collar 202 and extends substantially parallel with the first rotational axis 45. A pin 208 is slidably received in the slot and is fixed to the lower shaft portion 126 of the driving gear 110 for rotation therewith. With this arrangement, the driving gear 110 is constrained to rotate with the coupler 18 while permitting relative linear sliding movement of the coupler with respect to the driving gear. Each engagement member 204 preferably includes a curved edge 210 that faces inwardly toward the first rotational axis 45. As best shown in FIG. 4, the engagement members 204 extend radially along the lower surface 212 of the disk 200 and are equally spaced therearound.

The driving head 7 of a typical microwave oven having a removable turntable is shown in FIG. 2D. The driving head 7 typically includes a center portion 220 and engagement legs 222 that extend radially therefrom. Slots 224 are formed between the legs 222. The height of the driving head 7 and the radial length of each slot can vary among different microwave ovens. The slot 206 in the coupler 18 together with the pin or fastener 208 enables the invention to provide adjustment in the coupler height with respect to the base member 12 when the stirring device 10 is positioned in a microwave oven. The curved edges 210 of the engagement members 204 allow for differences in the radial length of each slot. Thus, the stirring device 10 is adaptable to many types of microwave ovens with driving heads of different configurations.

In use, the turntable (not shown) and any supporting structures for the turntable are removed from the interior of the microwave oven 5. The stirring device 10 is then positioned in the interior of the microwave oven such that the driving head coupler 18 is aligned over the driving head 7 with the suction cups 36 gripping the stationary support surface 226 (See FIG. 1) of the microwave oven. A container 94 with a sample or a liquid to be heated therein and a stirring bar are positioned on the raised platform 90. The microwave oven 5 is operated in the usual fashion to heat the sample or liquid in the container 94.

Figure 3:
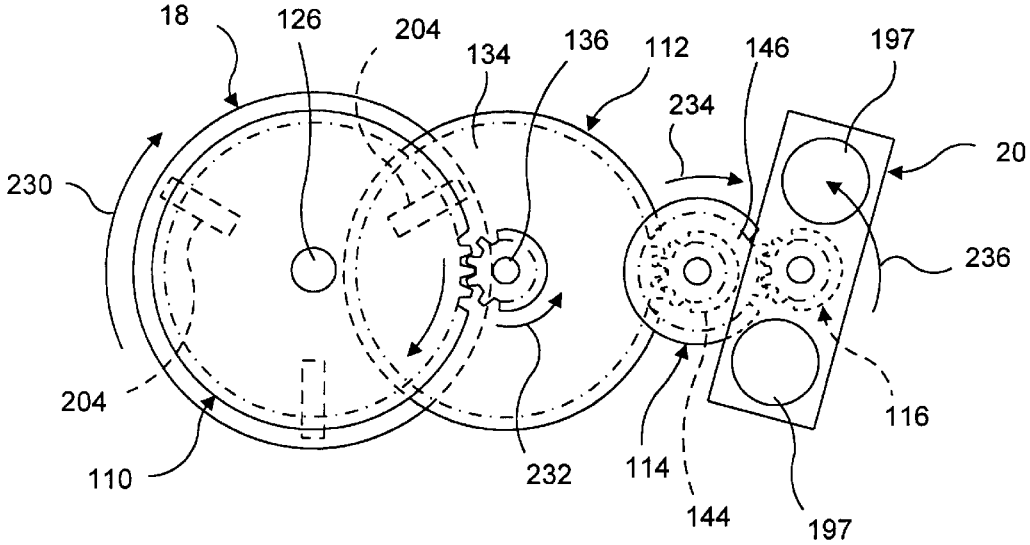
FIG. 3 is a schematical top plan view of rotational members of the magnetic stirring device according to the invention.

During operation of the microwave oven 5, and with particular reference to FIGS. 2D and 3, the engagement legs 222 of the driving head 7 rotate in a clockwise direction 230 and engage the members 204 of the coupler 18 to generate rotation of the coupler in the same direction. Rotation of the coupler 18 in the clockwise direction causes corresponding rotational movement in the driving gear 110. With the upper gear wheel 136 of the first gear set 112 intermeshed with the driving gear 110, rotation of the first gear set 112 in a counter-clockwise rotation 232 results. Likewise, with the lower gear wheel 144 of the second gear set 114 intermeshed with the lower gear wheel 134 of the first gear set 112, rotation of the second gear set 114 in a clockwise rotation 234 results. Finally, with the upper gear wheel 146 of the second gear set intermeshed with the gear wheel 162 of the driven gear 116, the magnetic actuator 20 rotates in a counter-clockwise direction 236 to drive the stirring bar 228 in the same direction and at the same revolutions per minute in the liquid sample. This motion stirs the liquid sample during heating. Although the gears and gear sets are described as rotating in a particular direction, the invention is not to be limited thereto, since the gears and gear sets may be arranged to rotate in other directions.

Preferably, the combination of gears and gear sizes results in a ratio of 50:1, wherein the actuator 20 (and consequently the stirring bar 228) rotates approximately 50 revolutions for each revolution of the microwave driving head 7. For a typical microwave oven, the driving head 7 may rotate at approximately five to six revolutions per minute, which in turn will cause the actuator 20 to rotate at approximately 250 to 300 revolutions per minute. Of course, other ratios can be obtained by varying the size of each gear wheel and the number of gear sets to obtain any desired revolutions per minute for the actuator 20.

The stirring device 10 is preferably constructed of microwave transparent material, with one possible exception of the magnets 197 and the magnetic responsive material of the stirring bar 228. The magnets 197 and magnetic material may be shaped and/or shielded in a well known manner to avoid arcing during operation of the microwave oven.

Figure 5:
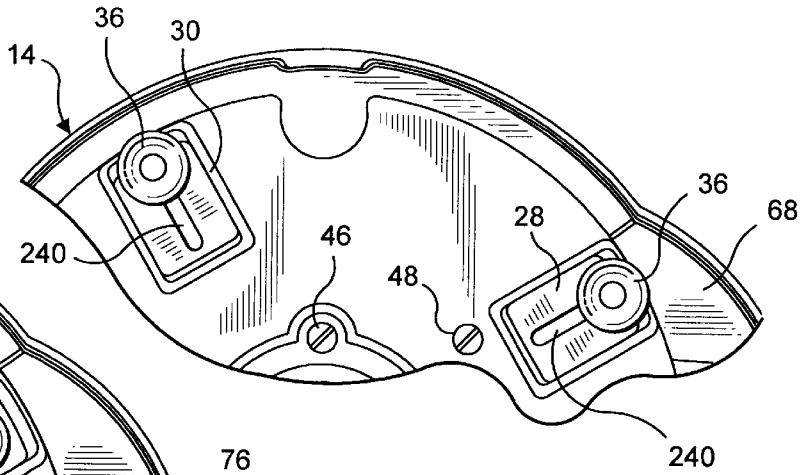
FIG. 5 is a bottom plan view of a portion of the magnetic stirring device according to a second embodiment of the invention.

With reference now to FIG. 5, a second embodiment of the stirring device 10 is illustrated, wherein like parts in the previous embodiment are represented by like numerals. In this embodiment, slots 240 replace the apertures 34 in the depressions 26, 28, 30 and 32. The top 40 of each suction cup 36 can be received within the slot and is enabled to slide relative thereto. This arrangement is especially advantageous where the dimension of the support surface 226 of different microwave ovens may vary. For microwave ovens having a relatively small supporting surface, the suction cups can be moved radially inwardly toward the first rotation axis 45 along their respective slots 240.

It is to be understood that the terms upper, lower, inner, outer, center, etc., and their respective derivatives, as well as the terms clockwise and counter-clockwise as used herein are intended to describe relative, rather than absolute directions and/or positions.

While the invention has been taught with specific reference to the above-described embodiments, those skilled in the art will recognize that changes can be made in form and detail without departing from the spirit and the scope of the invention. For example, the particular shape of the driving head coupler can vary greatly depending on the type of driving head that it is to engage. It is contemplated that the coupler may be removable from the driving gear and replaceable with different types of couplers for microwave ovens having different driving head configurations. Moreover, although the raised platform 90 is shown offset from the first rotational axis 45, the gears can be so arranged to as to locate the platform over the rotational axis 45 or at any other desired location.

While the invention has been described for heating and stirring chemical and biological samples, it is to be understood that hot drinks intended for human consumption or any other type of fluid can benefit from the above-described embodiments.

Thus, the described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed is:

1. A stirring device adaptable for use in a microwave oven having an interior heating compartment and a turntable driving head in communication with the compartment, the stirring device comprising:

contents that may be located in the container at the second rate of revolution.

2. A stirring device according to claim 1, wherein the driving head coupler comprises adjustment means for engaging turntable driving heads of different configurations.

3. A stirring device according to claim 2, wherein the driving gear includes a shaft with a longitudinal axis and a gear wheel mounted on the shaft for rotation around the longitudinal axis, and further wherein the adjustment means includes a collar that is slidably received on the shaft, so as to enable the driving head coupler to engage driving heads of different heights.

4. A stirring device according to claim 3, wherein the turntable driving head includes a center section and a slot extending from the center section, and further wherein the adjustment means includes a concave surface on the contact element facing the center section of the turntable driving head and the slot for engaging driving heads of different slot lengths when the stirring device is mounted in the interior compartment.

5. A stirring device according to claim 1, wherein the ratio of rotation of the driven gear with respect to the driving gear is approximately 50:1.

6. A stirring device according to claim 1, wherein the housing comprises a base member and a support member connected to the base member, the support member comprising the surface for supporting a container thereon.

7. A stirring device according to claim 6, and further comprising mounting means connected to the base member for removably mounting the stirring device in the interior compartment.

8. A stirring device according to claim 7, wherein the mounting means comprises suction cups connected to the base member for holding the stirring device on a surface of the interior compartment under vacuum pressure.

9. A stirring device according to claim 8, wherein the suction cups are slidable toward and away from a center portion of the base member for adjusting to interior compartment surfaces of different sizes.

10. A stirring device according to claim 7, wherein the mounting means comprises support elements arranged around a periphery of the base member.

11. A stirring device according to claim 10, wherein the support elements comprise suction cups connected to the base member for holding the stirring device on a surface of the interior compartment under vacuum pressure.

12. A stirring device according to claim 11, wherein the suction cups are slidable toward and away from a center portion of the base member for adjusting to interior compartment surfaces of different sizes.

13. A stirring device adaptable for use in a microwave oven having an interior heating compartment and a turntable driving head in communication with the compartment, the stirring device comprising:

a housing adapted for positioning in the compartment, the housing having a surface for supporting a container thereon;

a gear train assembly located in the housing; the gear train assembly having a driving gear, a driven gear, and at least one gear set connected therebetween, a ratio of rotation of the driven gear with respect to the driving gear being greater than unity;

a driving head coupler connected to the driving gear for rotation therewith, the driving head coupler having at least one contact element adapted for engaging the turntable driving head such that rotation of the driving head during use of the microwave oven causes rotation of the driving head coupler, the driving head coupler including an adjustment means for engaging turntable driving heads of different configurations; and a magnetic actuator connected to the driven gear for rotation therewith, the magnetic actuator comprises at least one magnet and a stirring element for positioning in the container at a location spaced from the actuator, the stirring element being magnetically responsive to said at least one magnet of the magnetic actuator for rotation therewith, wherein the turntable driving head rotates during operation of the microwave oven at a first rate of revolution and thereby causes a corresponding rotation of the magnetic actuator at a second rate of revolution greater than the first rate to thereby simultaneously heat and stir contents that may be located in the container at the second rate of revolution.

14. A stirring device according to claim 13, wherein the driving gear includes a shaft with a longitudinal axis and a gear wheel mounted on the shaft for rotation around the longitudinal axis, and further wherein the adjustment means includes a collar slidably received on the shaft for adjusting to turntable driving heads of different heights.

15. A stirring device according to claim 14, wherein the turntable driving head includes a center section and a slot extending from the center section, and further wherein the adjustment means includes a concave surface on the contact element that faces the center section of the driving head and the slot for adjusting to driving heads of different slot lengths when the stirring device is mounted in the interior compartment.

16. A stirring device according to claim 13, wherein the ratio of rotation of the driven gear with respect to the driving gear is approximately 50:1.

17. A stirring device according to claim 13, and further comprising mounting means connected to the housing for removably mounting the stirring device on a surface of the interior compartment.

18. A stirring device according to claim 17, wherein the mounting means are slidable on the housing for adjusting to interior compartment surfaces of different sizes.

* * * * *